US008499592B2

(12) United States Patent
Gokceimam et al.

(10) Patent No.: US 8,499,592 B2
(45) Date of Patent: Aug. 6, 2013

(54) WASHER/DRYER

(76) Inventors: Eyup Gokceimam, Istanbul (TR); Baris Unal, Istanbul (TR); Erman Cevikkalp, Istanbul (TR)

( * ) Notice: Subject to any disclaimer, the term of this patent is extended or adjusted under 35 U.S.C. 154(b) by 196 days.

(21) Appl. No.: 12/811,363

(22) PCT Filed: Dec. 6, 2008

(86) PCT No.: PCT/EP2008/066969

§ 371 (c)(1),
(2), (4) Date: Jun. 30, 2010

(87) PCT Pub. No.: WO2009/083403

PCT Pub. Date: Jul. 9, 2009

(65) Prior Publication Data

US 2010/0281925 A1 Nov. 11, 2010

(30) Foreign Application Priority Data

Dec. 31, 2007 (TR) ..... A2007 09228

(51) Int. Cl.
*D06F 17/00* (2006.01)

(52) U.S. Cl.
USPC ..... 68/196; 68/3 R; 312/228; 312/228.1

(58) Field of Classification Search
USPC ..... 68/196; 312/228–228.1
See application file for complete search history.

(56) References Cited

U.S. PATENT DOCUMENTS

| | | | | |
|---|---|---|---|---|
| 3,044,667 | A * | 7/1962 | Lucas | 222/454 |
| 3,173,730 | A * | 3/1965 | Collins | 312/223.5 |
| 2005/0132740 | A1 * | 6/2005 | Kwon | 62/441 |
| 2006/0086152 | A1 * | 4/2006 | Kim et al. | 68/196 |
| 2006/0086153 | A1 * | 4/2006 | Kim et al. | 68/196 |
| 2006/0086154 | A1 * | 4/2006 | Kim | 68/196 |
| 2006/0086155 | A1 * | 4/2006 | Kim et al. | 68/196 |
| 2006/0090521 | A1 * | 5/2006 | Kim et al. | 68/3 R |

FOREIGN PATENT DOCUMENTS

| | | | |
|---|---|---|---|
| DE | 29605880 | U1 * | 6/1996 |
| EP | 0728861 | A | 8/1996 |
| EP | 1741822 | A1 | 1/2007 |
| WO | 0234994 | A | 5/2002 |
| WO | 2006080788 | A | 8/2006 |

* cited by examiner

*Primary Examiner* — Michael Barr
*Assistant Examiner* — Jason Ko
(74) *Attorney, Agent, or Firm* — Venable, Campillo, Logan & Meaney PC

(57) ABSTRACT

The present invention relates to the items required to be close by while the washer/dryer (1) operates and which are stored in different places by the user can be stored on the washer/dryer (1) by saving space thereby providing easy access.

8 Claims, 3 Drawing Sheets

WASHER/DRYER

Figure 1:
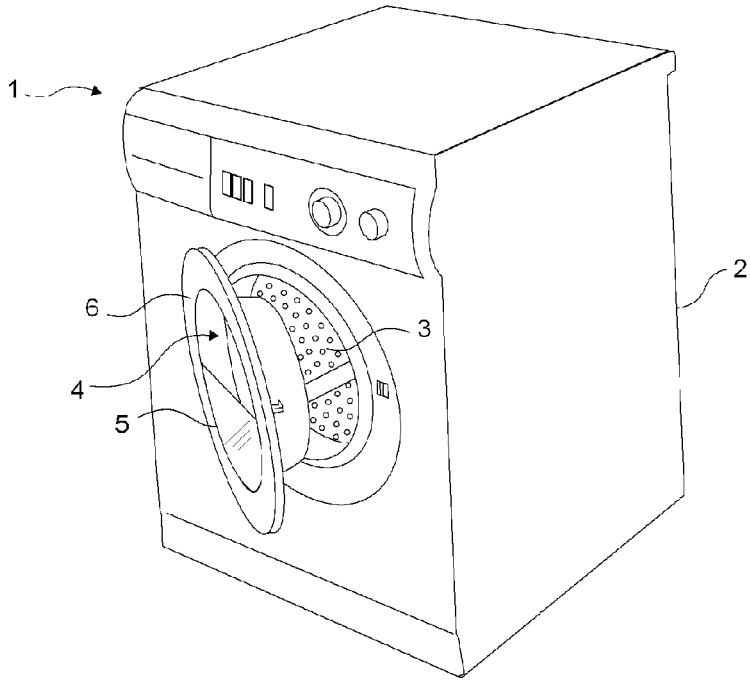

The present invention relates to a front loading washer/dryer.

In washers/dryers, users need materials such as detergent, washing additives (softener, bleaching agent etc.), operating manual, rag clothes during the use of the washer/dryer. Users store such materials in bathroom cabinets or on top of the washer/dryer while not in use. Storing such materials in a separate cabinet causes such materials required to be held close not to be easily accessible while the washer/dryer operates. Aesthetic problems arise in case the materials are stored on top of the washer/dryer.

In the state of the art, embodiments are developed for storing the materials assisting in cleaning etc. on the washer/dryer.

In the state of the art European Patent Application No EP1741822, a panel comprising shelves thereon covers the porthole door produced of glass, detergent dispenser and the whole front side of the washing machine.

In the state of the art International Patent Application No WO2006080788, the door glass of the washer/dryer is covered with a safety cover. The safety cover protects the front door against external influences and meanwhile prevents the user from being affected by the heat of the glass by contacting the front door.

In the state of the art embodiments, the dead zone, particularly in washing machines, formed by the portion extending into the drum while the cover is closed, cannot be used.

The aim of the present invention is the realization of a washer/dryer wherein the dead zone on the cover is used effectively.

The washer/dryer realized in order to attain the aim of the present invention, explicated in the first claim and the respective claims thereof, comprises a storage means disposed in the interior volume of the recessed container-shape of the cover that extends towards the inner side of the drum to be accessible from the part of the cover facing outside, enabling the items disposed in the interior volume to be carried and supported. Thus, the cover interior volume is enabled to be used as a storage volume. The storage means provides a usable additional volume on the washer/dryer by forming a housing that enables the items to be disposed in the interior volume of the cover.

In an embodiment of the present invention, the storage means at least partially covers the opening that allows the entry into the recessed volume of the cover. The storage means prevents the items from falling by forming an obstacle in front of the items disposed in the interior volume and serves as a barrier.

In an embodiment of the present invention, the storage means is produced of a resilient material preferably shaped as a net. In this embodiment, the storage means partially covering the opening provides more items to be disposed in the interior volume by stretching.

In another embodiment of the present invention, the washer/dryer comprises a shelf-shaped storage means dividing the interior volume at least into two by being disposed in the interior volume horizontally.

In yet another embodiment of the present invention, the washer/dryer comprises a door whereon the storage means is disposed, which covers the opening when closed and wherein the storage means is located in the interior volume, moving the storage means out of the interior volume when opened.

By means of the present invention, the items are stored on the washer/dryer by saving space and are easily accessed.

The washer/dryer realized in order to attain the aim of the present invention is illustrated in the attached figures, where:

FIG. 1—is the perspective view of a washer/dryer.

Figure 2:
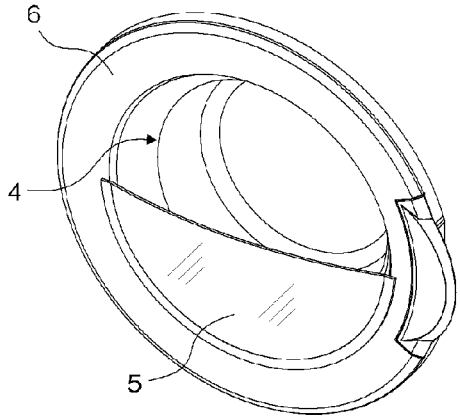

FIG. 2—is the perspective view of a cover and a storage means.

Figure 3:
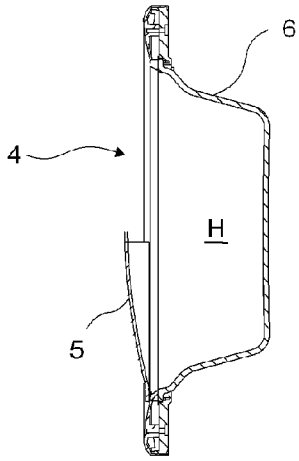

FIG. 3—is the cross sectional view of the cover and the storage means.

Figure 4:
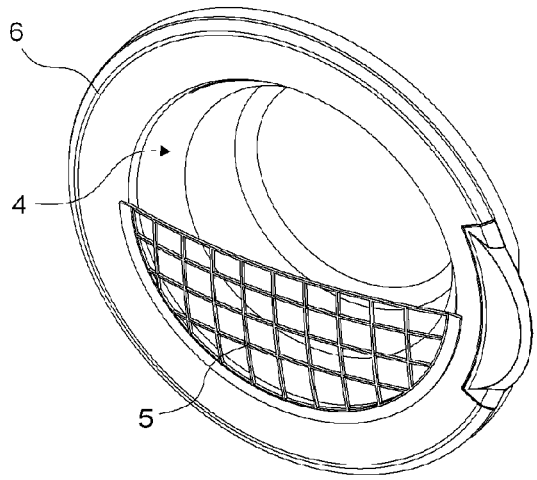

FIG. 4—is the perspective view of the cover and the net-shaped storage means.

Figure 5:
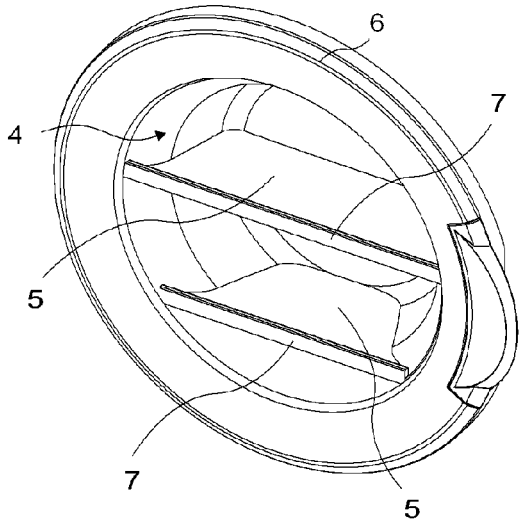

FIG. 5—is the perspective view of the cover and the shelf-shaped storage means.

Figure 6:
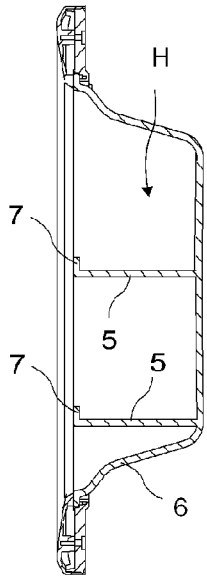

FIG. 6—is the cross sectional view of the cover and the shelf-shaped storage means.

Figure 7:
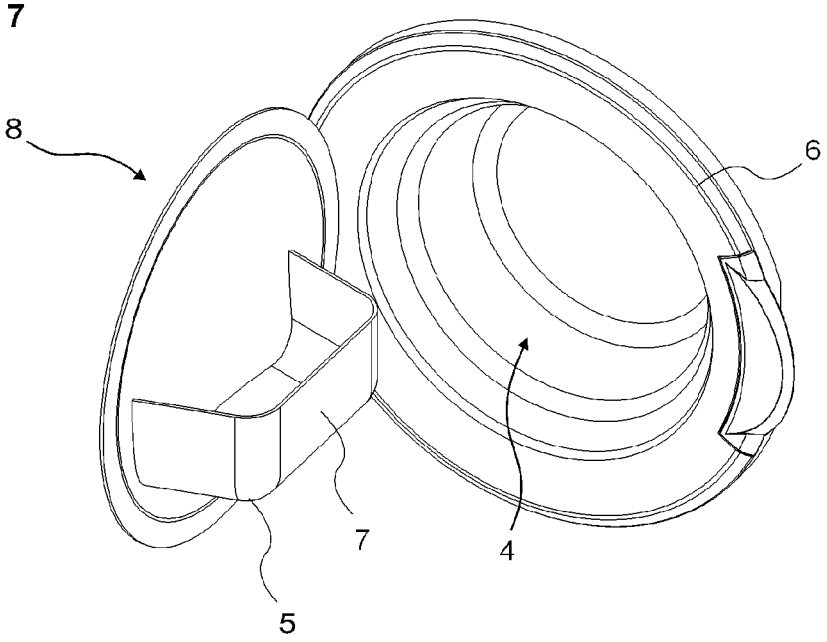

FIG. 7—is the perspective view of a door and a storage means while the door is open.

Figure 8:
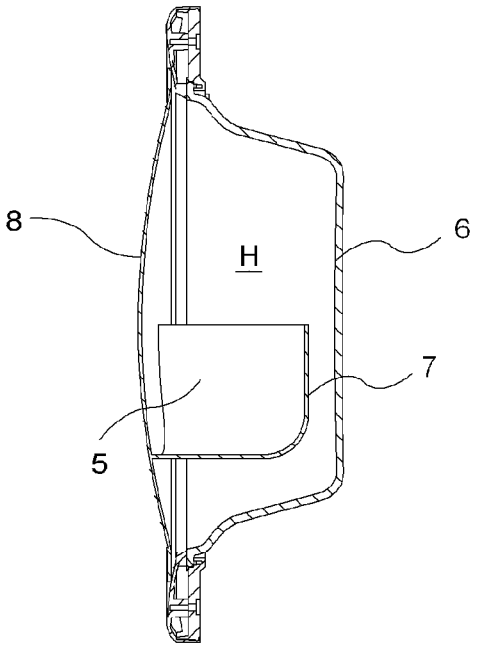

FIG. 8—is the cross sectional view of the door and the storage means while the door is closed.

The elements illustrated in the figures are numbered as follows:

1. Washer/dryer
2. Body
3. Drum
4. Opening
5. Storage means
6. Cover
7. Guardrail
8. Door The washer/dryer (1) of the present invention is front loading, which comprises a body (2), a drum (3) disposed in the body (2) wherein the laundry is disposed, a loading port disposed on the body (2) enabling the laundry to be loaded and unloaded, and a recessed container-shaped cover (6) mounted to the body (2) such that the loading port is covered and extending towards the inner side of the drum (3) when closed (FIG. 1).

The washer/dryer (1) furthermore comprises:

an opening (4) allowing access to the interior volume (H) of the concave portion that extends towards the inner side of the drum (3) when the cover (6) is closed and a storage means (5) mounted into the interior volume (H) of the cover (6) or to the side of the concave portion, for holding and supporting the items that are disposed in the interior volume (H).

Thus, the storage means (5) provides the items to be carried on the cover (6) or supports the items disposed thereon, preventing from falling by enabling the items disposed in the interior volume (H) to be held and supported.

By means of the storage means (5), one or more housings are formed in the cover (6) interior volume (H), wherein items can be emplaced. Access of the user into the interior volume (H) is provided through the opening (4) disposed in front of the cover (6). Thus, the user can emplace the required cleaning agents such as detergent, softener etc. in the interior volume (H). The items can be stored in the interior volume (H) since the storage means (5) forms a support surface whereon the items disposed in the interior volume (H) can be held or a barrier preventing the items from falling.

In another embodiment of the present invention, the storage means (5) at least partially covers the opening (4) providing access to the interior volume (H) (FIG. 2, FIG. 3 and FIG. 4). In this embodiment, the storage means (5) prevents the items from falling from the interior volume (H) by forming a barrier in front of the items disposed in the interior volume (H). Thus, the items remain in the housing formed in the interior volume (H) between the storage means (5) and the cover (6).

In another version of this embodiment of the present invention, the storage means (5) is produced of a resilient material preferably shaped as a net. In this embodiment, the storage means (5) partially covering the opening (4), enables larger items to be disposed in the interior volume (H) by stretching (FIG. 4).

In another embodiment of the present invention, the washer/dryer (1) comprises a shelf-shaped storage means (5) that divides the interior volume (H) at least into two and enables the items disposed thereon to be carried by being mounted horizontally to the interior volume (H) of the cover (6). The storage means (5) enables the items disposed thereon to be carried in the interior volume (H) by serving as a shelf. In this embodiment of the present invention, the washer/dryer (1) furthermore comprises a guardrail (7) situated on the sides of the storage means (5) for preventing the items disposed on the storage means (5) from falling (FIG. 5 and FIG. 6).

In yet another embodiment of the present invention, the washer/dryer (1) comprises a door (8) whereon the storage means (5) is mounted, entirely covering the opening (4), providing the storage means (5) to remain in the interior volume (H) when closed, and enabling the storage means (5) to move out of the interior volume (H) when opened. The door (8) is mounted such that the opening (4) will be entirely covered when closed onto the cover (6) or body (2). The storage means (5) is inserted into the interior volume (H) when the door (8) is closed and enables the items disposed thereon to be stored in the interior volume (H). When the door (8) is opened, the storage means (5) can be accessed by the user (FIG. 7 and FIG. 8).

By means of the present invention, the cover (6) acquires an additional function by storing items in the interior volume (H) of the recessed container-shaped portion extending towards the inner side of the drum (3) when the cover (6) is closed. Thus, the items stored in different places by the user are enabled to be stored on the washer/dryer (1) without requiring an additional volume.

The invention claimed is:

1. A washer/dryer (1) comprising a body (2), a drum (3) disposed in the body (2) wherein the laundry is disposed, a loading port disposed on the body (2) enabling the laundry to be loaded and unloaded, and a concave container-shaped cover (6) mounted to the body (2) such that the loading port will be covered and extending towards the inner side of the drum (3) when closed, and characterized by an opening (4) allowing access to the interior volume (H) of the concave portion that extends towards the inner side of the drum (3) when the cover (6) is closed and a storage means (5) mounted into the interior volume (H) of the cover (6) or to the side of the concave portion, for holding and supporting the items that are disposed in the interior volume (H), wherein the storage means (5) is a net-shaped storage means.

2. The washer/dryer (1) as in claim 1, wherein the storage means (5) is produced of a resilient material.

3. A washer/dryer (1) comprising a body (2), a drum (3) disposed in the body (2) wherein the laundry is disposed, a loading port disposed on the body (2) enabling the laundry to be loaded and unloaded, and a concave container-shaped cover (6) mounted to the body (2) such that the loading port will be covered and extending towards the inner side of the drum (3) when closed, and characterized by an opening (4) allowing access to the interior volume (H) of the concave portion that extends towards the inner side of the drum (3) when the cover (6) is closed and a storage means (5) mounted into the interior volume (H) of the cover (6) or to the side of the concave portion, for holding and supporting the items that are disposed in the interior volume (H), further comprising a door (8) whereon the storage means (5) is mounted, entirely covering the opening (4) and providing the storage means (5) to remain in the interior volume (H) when closed, enabling the storage means (5) to move out of the interior volume (H) when opened.

4. The washer/dryer (1) as in claim 3, wherein the storage means (5) is produced of a resilient material.

5. A front loading washer/dryer (1) that comprises a body (2), a drum (3) disposed in the body (2) wherein the laundry is disposed, a loading port disposed on the body (2) enabling the laundry to be loaded and unloaded in the front loading washer/dryer, and a concave container-shaped cover (6) mounted to the body (2) such that the loading port will be covered and extending towards the inner side of the drum (3) when closed, and characterized by an opening (4) allowing access to the interior volume (H) of the concave portion that extends towards the inner side of the drum (3) when the cover (6) is closed and a storage means (5) mounted into the interior volume (H) of the cover (6) or to the side of the concave portion, for holding and supporting the items that are disposed in the interior volume (H) and wherein the storage means (5) forms a support surface whereon the items disposed in the interior volume (H) can be held or a barrier preventing the items from falling and wherein the storage means is a net-shaped storage means.

6. The washer/dryer (1) as in claim 5, wherein the storage means at least partially covering the opening (4) allows access to the interior volume (H).

7. The washer/dryer (1) as in claim 6, wherein the storage means (5) is produced of a resilient material.

8. The washer/dryer (1) as in claim 5, wherein the storage means (5) is produced of a resilient material.

* * * * *